US008541709B2

(12) United States Patent
Calin et al.

(10) Patent No.: US 8,541,709 B2
(45) Date of Patent: Sep. 24, 2013

(54) METHOD FOR ELECTROSTATICALLY SEPARATING A GRANULE MIXTURE MADE OF DIFFERENT MATERIALS, AND DEVICE FOR IMPLEMENTING SAME

(75) Inventors: Laur-Florentin Calin, Cluj Napoca (RO); Lucien Dascalescu, Angouleme (FR)

(73) Assignees: APR2, Bonnieres-sur-Seine (FR); Universite de Poitiers, Poitiers (FR)

( * ) Notice: Subject to any disclaimer, the term of this patent is extended or adjusted under 35 U.S.C. 154(b) by 103 days.

(21) Appl. No.: 13/259,874

(22) PCT Filed: Mar. 23, 2010

(86) PCT No.: PCT/FR2010/000245

§ 371 (c)(1),
(2), (4) Date: Dec. 20, 2011

(87) PCT Pub. No.: WO2010/109096

PCT Pub. Date: Sep. 30, 2010

(65) Prior Publication Data

US 2012/0085683 A1 Apr. 12, 2012

(30) Foreign Application Priority Data

Mar. 27, 2009 (FR) ..... 09 01494

(51) Int. Cl.

| | |
|---|---|
| ***B03C 7/00*** | (2006.01) |
| ***B04B 5/10*** | (2006.01) |
| ***B07B 15/00*** | (2006.01) |
| ***B03C 3/00*** | (2006.01) |

(52) U.S. Cl.

USPC ..... 209/127.2; 209/127.1; 209/128; 209/129; 209/130; 209/12.2; 95/78; 96/63

(58) Field of Classification Search

USPC ..... 209/127.1, 127.2, 128–130, 12.1, 209/12.2, 138, 715, 722; 95/78; 96/63

See application file for complete search history.

(56) References Cited

U.S. PATENT DOCUMENTS 3,493,109 A * 2/1970 Carta et al. ..... 209/11
4,627,579 A 12/1986 Rich (Continued)

FOREIGN PATENT DOCUMENTS

DE 26 43 002 11/1977
DE 199 12 462 2/2000

(Continued)

OTHER PUBLICATIONS

International Search Report Issued Aug. 11, 2010 in PCT/FR10/000245 Filed Mar. 23, 2010.

*Primary Examiner* — Patrick Cicchino

(74) *Attorney, Agent, or Firm* — Oblon, Spivak, McClelland, Maier & Neustadt, L.L.P.

(57) ABSTRACT

A method and a device for electrostatically separating polyvalent granular insulating materials that have good properties, are energy efficient, and easily adapt to ambient atmospheric conditions and to physiochemical properties of the granules to be separated. The method includes: a) injecting a current of air between two electrodes in a separation chamber defined by walls and having an air inlet and outlet; b) placing the granule mixture, made of different materials, into the air current; c) controlling the air current so that the granules levitate in the air current in a turbulent mode and become electrically charged by contact therebetween and/or by contact with the walls of the separation chamber; d) generating an electric field between two electrodes, substantially perpendicular to the direction of the air current, such that the charged granules in c) move, either in the direction of the electric field if the granules are positively charged or in the opposite direction if the charge thereof is negative; e) adhering the charged granules to the surface of the electrodes; and f) discharging and collecting the granules adhering to each electrode.

21 Claims, 2 Drawing Sheets

(56) References Cited

U.S. PATENT DOCUMENTS

Figure 1:
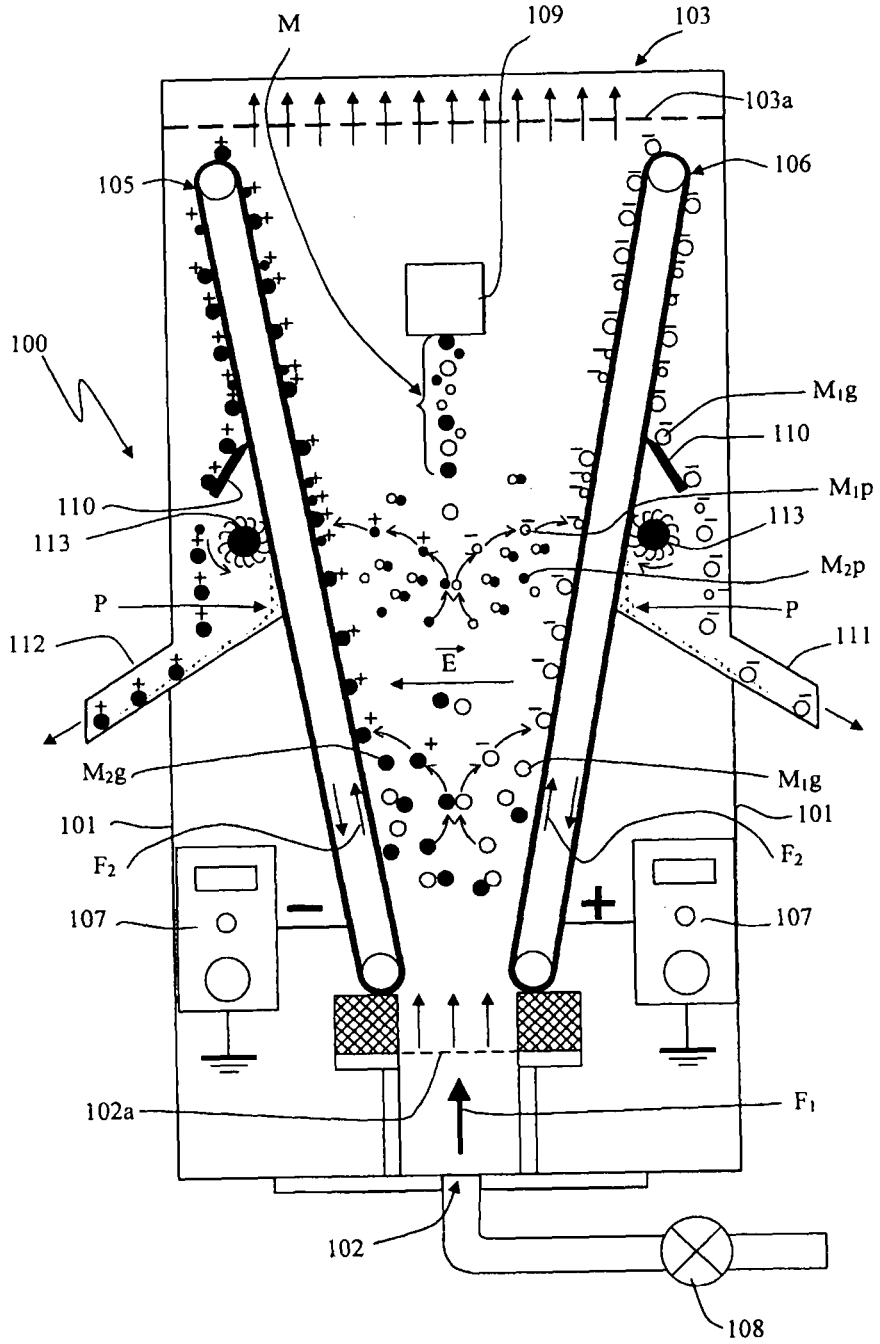

| | | | | |
|---|---|---|---|---|
| 4,743,362 | A * | 5/1988 | Pfoh et al. | 209/127.4 |
| 4,895,642 | A * | 1/1990 | Frei | 209/127.3 |
| 5,885,330 | A * | 3/1999 | Lee | 95/69 |
| 6,011,229 | A * | 1/2000 | Geisler et al. | 209/127.4 |
| 6,074,458 | A * | 6/2000 | Bittner et al. | 95/60 |
| 6,329,623 | B1 * | 12/2001 | Yan et al. | 209/129 |
| 6,452,126 | B1 * | 9/2002 | Xiao et al. | 209/127.1 |
| 6,651,818 | B1 * | 11/2003 | Ilmasti et al. | 209/12.2 |
| 6,773,489 | B2 * | 8/2004 | Dunn | 95/78 |
| 7,119,298 | B2 * | 10/2006 | Yoshiyama et al. | 209/127.1 |
| 2009/0107893 | A1 * | 4/2009 | Schembri et al. | 209/127.1 |

FOREIGN PATENT DOCUMENTS

| | | |
|---|---|---|
| EP | 0 279 200 | 8/1988 |
| FR | 1 574 621 | 7/1969 |
| JP | 57 42355 | 3/1982 |
| JP | 57042355 A * | 3/1982 |

* cited by examiner

METHOD FOR ELECTROSTATICALLY SEPARATING A GRANULE MIXTURE MADE OF DIFFERENT MATERIALS, AND DEVICE FOR IMPLEMENTING SAME

The invention relates to a method for electrostatically separating granular materials and to a device for implementing the method.

Electrostatic separation methods are already used to sort mixed granular materials which originate, for example, from the grinding of industrial waste. Preferably, these materials are insulating materials.

Thus, the recycling of electrical and/or electronic waste entails separating the different components before the materials obtained can be valued. This separation must be as effective as possible to obtain a substantially constant quality of the materials obtained. It is therefore worth considering creating and future-proofing a downstream line for valuing these materials. For example, the plastic materials retrieved from the electrical and/or electronic waste may be used in the manufacture of terrace outline boards. To future-proof this activity, the boards need to have a quality and a color that are substantially constant.

There is also a need to be able to separate and recover plastic materials of different types, effectively and automatically.

A number of types of methods have been proposed, such as optical or float-based methods. However, these methods are not accurate enough and generate too many impurities.

Another solution is to grind the insulating materials so as to turn them into granules and, in a first step, to charge these granules by triboelectric effect in a vibration or rotary device. In a second step, the charged granules are conveyed to an electrostatic sorting device in which they are separated by an electric field.

To this end, the granules are injected from the top of the sorting device where they fall by gravity between two parallel and vertical electrodes.

Hereinafter in this application, the term "vertical" will be understood to mean the direction substantially parallel to the force of gravity. Similarly, the term "horizontal" will be understood to mean the direction substantially perpendicular to the force of gravity.

The positively charged granules are attracted by the anode (the negative electrode), whereas the negatively charged granules are attracted by the cathode (the positive electrode).

The granules which are thus deflected in their fall are separated and fall into two different collectors, arranged at the bottom of the device and in line with the electrodes.

The granules which have not been attracted by the electrodes fall into a third central collector where they are recovered. They can then be recirculated into the sorting device.

These granules may have lost their charge during conveying between the triboelectric charging device and the sorting device. They may also have acquired too weak a charge to be attracted by an electrode.

In fact, the electrical charge acquired by the granules in the abovementioned devices is not uniform. Some granules manage to be charged appropriately and can therefore be separated in a fairly intense electric field, whereas others leave the triboelectric charging devices with a charge level that is insufficient to enable them to be separated. The result is that a significant quantity of unseparated granules must be recovered and then returned to the triboelectric charging device. The productivity of the method is low since the return of the granules into the triboelectric charging device limits the charging of new granules.

The state of charge of the granules could be improved by increasing the duration of the triboelectric charging process. However, the productivity of the method would not be improved since the granules would remain longer in the triboelectric charging device, which consumes time and energy.

Furthermore, for a fixed charging duration, the quantity of charge actually acquired by the granules may vary significantly with the surface condition of the granules and, more particularly, their size. As it happens, when two granules of different sizes collide, they acquire two opposite electrical charges of the same value. However, while this value is sufficient for the smallest granule to be attracted by one electrode, it is insufficient for the largest granule to be attracted by the other electrode. It is then removed and redirected to the charging device.

To improve the quality of the triboelectric charging of the granules, the known installations therefore have, preferably, means for screening by granule size, arranged upstream of the triboelectric charging device. Next, each type of granule is charged and then electrically separated.

The quantity of charge actually acquired by the granules may also vary significantly with ambient temperature and humidity.

To resolve the problem of atmospheric conditions, it is desirable to use means for controlling the humidity and the temperature of the ambient atmosphere and of the granules.

However, these additional plants greatly complicate the management of the overall installation and significantly increase the cost of the method.

The productivity of the known installations for separating granular insulating materials is fairly low and the quality of the products obtained does not always meet the requirements of the clients. The current methods are too sensitive to the random variations in the ambient conditions and in the physico-chemical properties of the granules to be separated.

The present invention aims to overcome the above drawbacks and proposes a method for electrostatically separating granular insulating materials and a device for implementing same, which are efficient in terms of triboelectric charging and sorting quality and productivity. They are also multipurpose, economical in terms of energy and can easily be adapted to the ambient atmospheric conditions and to the physico-chemical properties of the granules to be separated.

To this end, the invention proposes a method and a device that make it possible, simultaneously, within one and the same enclosure, to electrically charge the granules and electrostatically separate them.

Thus, the subject of the invention is a method for electrostatically separating a mixture of granules of different materials, comprising the following steps:

a) injection, between two electrodes in a separation chamber delimited by walls and provided with an air inlet and outlet, of a current of fluidizing air;
b) introduction of the mixture of granules of different materials into the current of fluidizing air;
c) control of the current of fluidizing air, so that the granules levitate in the current of air in a turbulent mode and become electrically charged by contacts between them and/or with the walls of the separation chamber;
d) generation of an electric field between the two electrodes, substantially perpendicularly to the direction of the current of air, such that the granules charged in step c) are displaced either in the direction of the electric field if they are charged positively or in the opposite direction if their charge is negative;
e) adhesion of the charged granules to the surface of the electrodes;

f) removal and collection of the granules adhered to each electrode.

According to other embodiments:

in step a), the current of fluidizing air can be injected substantially vertically upward, and in step b), the granule mixture is introduced by free fall and in counterflow relative to the current of fluidizing air;

the current of fluidizing air, injected into the separation chamber in step a), may exhibit a negative pressure gradient in the vertically upward direction;

the introduction of the granule mixture in step b) can be carried out at a rate, expressed in terms of weight of granules introduced per unit of time, regulated to a value substantially equal to the weight of granules collected in step f) per unit of time;

the current of air can be previously heated before entering into the separation chamber;

the current of air can be homogenized on entering into the separation chamber;

step f) can be implemented by means of conveyor belt-type electrodes made of electrically conductive material, the removal of the granules being performed by translating the conveyor belts, and the collection being carried out by scraping; and/or the method may also include a step g), after step f), of cleaning the electrodes.

Also the subject of the invention is a device for electrostatically separating a mixture of granules of different materials, characterized in that it comprises:

a separation chamber delimited by walls and provided with an air inlet and outlet;

two electrodes extending into the separation chamber between the air inlet and outlet;

a means for injecting, between the two electrodes, a current of fluidizing air in a determined direction;

a means for introducing the mixture of granules into the current of fluidizing air;

a means for controlling the current of fluidizing air such that, in use, the granules levitate in the current of air in a turbulent mode and are electrically charged by contacts between them and/or with the walls of the separation chamber;

a means for generating, between the two electrodes, an electric field substantially perpendicularly to the direction of the current of air;

a means for removing and for collecting the granules adhered to each electrode.

According to other embodiments:

the air inlet can be arranged so that the current of air is, in use, substantially vertically upward;

the means for introducing the mixture of granules can be arranged to introduce the granules, into the separation chamber, by free fall and in counterflow relative to the current of fluidizing air;

the electrodes can be arranged so as to diverge from the air inlet toward the air outlet;

the separation device may include a means for heating the current of air arranged upstream of the air inlet of the separation chamber;

the separation device may include an air chamber arranged downstream of the air inlet of the separation chamber and including means for homogenizing the current of air;

the means for homogenizing the current of air may be glass balls;

the separation device may include a means for controlling the rate of introduction of the granules;

the separation device may include a means for measuring the weight of granules collected, linked to the means for controlling the rate, the latter being adapted to control the rate of introduction of the granules according to the weight measured by the measurement means;

the means for collecting the granules may be a scraper;

the separation device may include a means for cleaning the electrodes;

the electrodes may be of conveyor belt type; and/or the means for generating the electric field may be adjustable.

The method and the device according to the invention make it possible to remedy the abovementioned drawbacks by simultaneously carrying out the charging of the granules by triboelectric effect and their separation in an electric field. Thus, the granules cannot lose their charge between the moment when they are charged and the moment when they are subjected to the electric field.

Moreover, the current of air separates the granules by size, so that the triboelectric charging is optimal since it is done on granules substantially of the same size.

Furthermore, each granule remains in the current of air only for the minimum time needed to acquire a sufficient triboelectric charge for it to be attracted by one of the electrodes. The uncharged granules cannot leave the current of air, which ensures the purity of the granules collected. Thus, the method and the device according to the invention optimize the sorting efficiency and adapts naturally to each granule.

Finally, because the charging and the separation are simultaneous and take place in one and the same enclosure, it is possible to easily, and economically, control the ambient atmospheric conditions.

Thus, a device according to the invention offers a sorting efficiency and quality that are significantly enhanced compared to a device of the state of art of equivalent useful dimensions.

Figure 2:
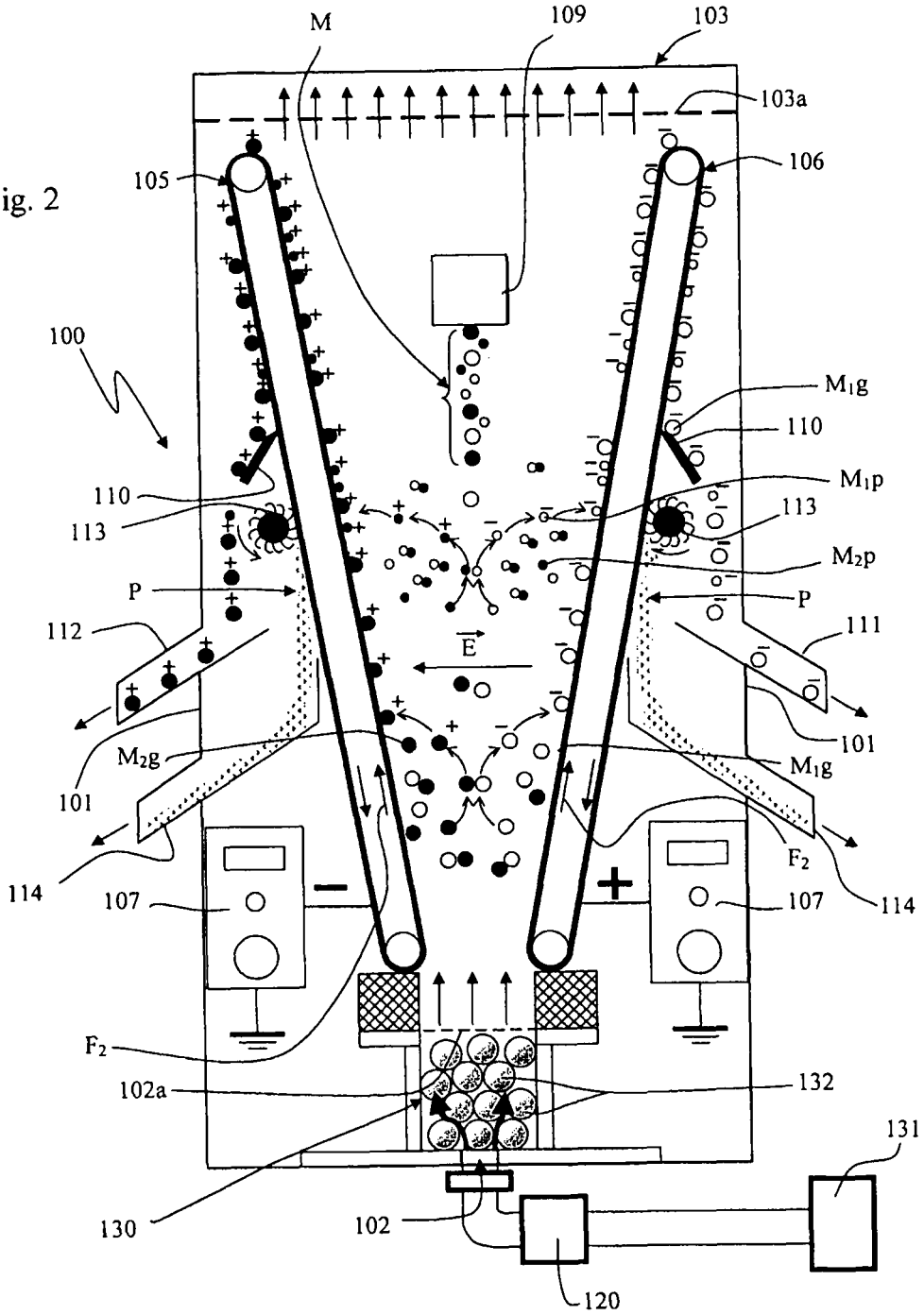

Other features of the invention will be stated in the following detailed description given with reference to the figures which represent, respectively:

FIG. 1, a schematic view in longitudinal cross section of a first embodiment of an electrostatic separation device according to the invention; and FIG. 2, a schematic view in longitudinal cross section of a second embodiment of an electrostatic separation device according to the invention.

With reference to FIG. 1, an electrostatic separation device according to the invention comprises a separation chamber 100 delimited by lateral walls 101 (of which only two are illustrated) and provided with an air inlet 102 and an air outlet 103 respectively allowing for the intake and exhaust of compressed air.

Preferably, the air inlet 102 is provided with an air diffuser 102*a*, and the air outlet 103 is provided with a filter 103*a*.

Two electrodes 105-106 extend into the separation chamber between and on either side of the air inlet and outlet. Thus, the current of air circulating between the air inlet and outlet is located between the electrodes 105-106. These electrodes are linked to a high DC voltage generator 107, preferably adjustable: the electrode 105 is linked to the negative terminal of the generator 107, and the electrode 106 is linked to the positive terminal of the generator 107. This arrangement generates an electric field between the two electrodes 105-106 when the current flows.

Preferably, as illustrated in FIGS. 1 and 2, the electrodes are arranged so as to diverge from the air inlet toward the air outlet.

The device also includes a means 108 for injecting, between the two electrodes 105-106, a current of air in a determined direction represented by the arrow F1. The current of air therefore passes through the separation chamber 100 between the air inlet 102 and the air outlet 103. This current of air forms a fluidized bed. The air inlet 102 is arranged, advantageously, so that the current of air is, in use, substantially vertically upward.

A means 109 is arranged to allow the introduction of a mixture M of granules into the current of fluidizing air.

Preferably, the means 109 for introducing the mixture of granules M is arranged to introduce the granules, into the separation chamber 100, by free fall and in counterflow relative to the current of fluidizing air.

The means 109 is, preferably, a variable rate means controlled by a rate control means (not illustrated).

The mixture M comprises at least two different materials M1-M2, illustrated in the figures by white disks M1 and black disks M2. The granules may be of different sizes. In the figures, two sizes (small size: M1*p* and M2*p*, and large size: M1*g* and M2*g*) are illustrated, but in practice, the method and the device according to the invention can effectively separate granules of numerous sizes.

The means 108 for injecting the current of fluidizing air is linked to a means for controlling the current of fluidizing air such that, in use, the granules levitate in the current of air in a turbulent mode and are electrically charged by contacts between them and/or with the walls 101 of the separation chamber 100.

The device according to the invention makes it possible to implement the method for electrostatically separating the mixture of granules of different materials according to the invention. It comprises the following steps.

In a step a), a current of fluidizing air is injected between the two electrodes. This current of air comes from the air inlet 102 and is removed through the air outlet 103. In the advantageous configuration illustrated in FIGS. 1 and 2, the current of fluidizing air is injected roughly vertically upward. Combined with this upward current, the divergent configuration of the electrodes creates a negative pressure gradient in the vertically upward direction. In other words, the air pressure decreases in the direction of the current of air. Thus, the pressure of the air at the air outlet 103, at the top of the chamber 100, is lower than the pressure of the air at the air inlet 102, at the bottom of the chamber 100.

In a step b), the mixture of granules M of different materials is introduced into the current of fluidizing air. In the above-mentioned advantageous configuration, the mixture of granules is introduced by free fall and in counterflow relative to the current of fluidizing air.

Simultaneously, in a step c), the current of fluidizing air is controlled so that the granules levitate in the current of air in a turbulent mode and are electrically charged by contacts between them and/or with the walls of the separation chamber.

The negative pressure gradient makes it possible to distribute the granules at different heights, relative to their dimensions: the larger or heavier granules remain at the bottom, whereas the smaller or lighter granules rise more into the fluidized bed. The upper limit of the fluidized bed is established by the smallest or lightest granules, but the current of air is controlled so that this upper limit does not exceed, preferably, two thirds of the height of the separation chamber 100.

The method and the device according to the invention therefore allow natural distribution of the granules according to their weight actually within the chamber. There is therefore no need for any screening by size of the mixture M before introduction into the separation chamber 100. The characteristic diameter of the granules of the mixture M may lie between, advantageously, 0.5 and 5 mm.

The method and the device according to the invention therefore make it possible to obtain a dimensional uniformity of the granules which come into contact with one another. This ensures the best triboelectric charging conditions because two granules roughly of the same weight, but of different materials, acquire opposite charges of the same value. This enables the granules each to be attracted by an electrode.

While the granules M1*p*-M2*p*, M1*g*-M2*g* levitate in the current of fluidizing air and are charged by triboelectrification, in a step d), an electric field E is generated between the two electrodes, roughly perpendicularly to the direction F1 of the current of air, and directed from the cathode to the anode.

The electric field needed to implement the invention is greater, preferably, than 1 kV/cm. It is typically between 4 and 5 kV/cm.

Thus, the granules charged in step c) are displaced, either in the direction of the electric field if they are positively charged, or in the opposite direction if their charge is negative. In FIGS. 1 and 2, the granules M1*p* and M1*g* are negatively charged and are displaced toward the cathode 106, in the direction opposite to the electric field E. The granules M2*p* and M2*g* are positively charged and are displaced toward the anode 105, in the same direction as that of the electric field E.

When subjected to the action of the electrical image force, the positively charged granules M2*p* and M2*g* adhere, in step e), to the anode 105. Similarly, the negatively charged granules M1*p* and M1*g* adhere, in a step e), to the cathode 106.

The method according to the invention includes a step f) for the removal and collection of the granules adhered to each electrode.

According to a preferred embodiment, this step f) is implemented using conveyor belt-type electrodes, advantageously made of an electrically conductive material such as a metal. Preferably, the conveyor belt is made of stainless steel with a smooth surface. The use of conveyor belts made of plastic materials with metallic insertions may also be envisaged.

According to the embodiments illustrated in FIGS. 1 and 2, the electrodes 105 and 106, of conveyor belt type, are translated to remove the granules deposited on their surface in a direction diagrammatically represented by the arrow F2, roughly the same direction as the current of air. It is also possible to drive the conveyor belts in the reverse direction, that is to say, roughly in counterflow relative to the current of air. However, the granules adhered to the surface of the conveyor belts run the risk of being unstuck by the current of air.

The conveyor belts remove the granules opposite to the current of air relative to the electrodes. Next, the granules are collected on the conveyor belts by scraping, using scrapers 110. These unstick the granules from the conveyor belts and direct them to a collector 111-112.

The speed of the belt is correlated with the rate of granules coming from the means 109 for introducing the mixture M of granules, the initial composition of the granular mixture to be separated and the width of the belt.

It has to be sufficient for the granules attracted by the electrode to form only a single layer on the surface of the belt. Otherwise, the electrical image force is not great enough to cause the granules to adhere to the belt.

Moreover, by using a speed that is too low, the granules would remain in contact with the belt of the electrodes for long enough for them to discharge. This has the effect of reducing the electrical image force which causes the granules to adhere to the surface of the belt. The granules then run the risk of being detached from the belt before being able to be recovered by the collectors 111-112, and of falling back to the base of the electrodes. It the current of air is as wide as the distance separating the base of each electrode, the granules which fall back may be returned to circulation in the current of air. Otherwise, the granules drop into the bottom of the chamber 100 and have to be recovered and then reintroduced into the chamber via the means 109.

As an example, with the plastic materials originating from computer waste, a rate of approximately 300 kg/hour and a belt with a width of 1 m, a speed of around 5 m/min may be sufficient.

The method according to the invention may also include a step g) for cleaning the electrodes, after step f). To this end, the separation device according to the invention includes a means for cleaning the electrodes, diagrammatically represented in FIGS. 1 and 2 by brushes 113. These are used to unstick the granules which may not have been unstuck by the scrapers 110. They are used in particular to clear the conveyor belts of the dust P inevitably generated by the implementation of the method. In fact, the impacts of the granules on one another, during the triboelectric charging, give rise to a certain erosion of these granules which takes the form of dust. This builds up on the conveyor belts and may reduce the adhesion of the granules by the electric image force. The brushes 113 are used to clear the belts of this dust and to maintain the attraction and adhesion power throughout the duration of operation of the device.

Preferably, as illustrated in FIG. 1, the collectors 111-112 are in tight contact with the corresponding conveyor belt 106-105 to gather the dust and remove it from the chamber 100. Alternatively, as illustrated in FIG. 2, the dust P may be removed by a dedicated collector 114.

Other means can be used, provided that they allow the removal and the collection of the granules adhered to each electrode. It is possible, for example, to use rotary electrodes combined with a scraper positioned opposite the current of fluidizing air relative to the electrodes. It is also possible to use a removal and collection means that is mobile relative to an immobile electrode.

With the method and the device according to the invention, the charging is done actually within the separation chamber, so that the granules do not run the risk of losing their charge before being subjected to the electric field.

Furthermore, as soon as a granule is charged, it is attracted by the electrode of opposite polarity. Each granule therefore remains in the current of triboelectric charging air only for the time needed to acquire a sufficient charge for it to be attracted by an electrode. This allows optimum efficiency, by leaving space for other granules and by using only the mechanical energy of the current of air strictly necessary for the acquisition of the triboelectric charge.

Finally, the fact that the granules are immediately removed as soon as they adhere to an electrode also optimizes the efficiency, since the granules do not have time to lose their charge, and leaves space for other granules to adhere to the electrodes.

Preferably, the device includes a means for controlling the rate of introduction of the granules, linked to a means (not represented) for measuring the weight of granules collected by the collectors 111-112.

Thus, the introduction of the mixture of granules in step b) is carried out at a rate, expressed in terms of weight of granules introduced per unit of time, regulated to a value substantially equal to the weight of granules collected in step f) per unit of time. In other words, the means for controlling the rate is adapted to control the rate of introduction of the granules according to the weight measured by the measurement means.

According to the embodiment illustrated in FIG. 2, the current of air is previously heated before entering into the separation chamber. To this end, the electrostatic separation device according to the invention includes a means 120 for heating the current of air, arranged upstream of the air inlet 102 of the separation chamber 100. This heating means 120 can be used to adjust the temperature of the fluidizing air to an optimum temperature to reduce the surface humidity of the granules and improve the conditions of electrification by triboelectric effect. For example, with a mixture of granules of ABS (acrylonitrile butadiene styrene) and HIPS (high impact polystyrene) materials, with a size of between 1.5 and 3 mm, this optimum temperature is between 35° C. and 45° C.

The electrostatic separation device according to the invention may also include an air chamber 130, arranged downstream of the air inlet 102 of the separation chamber 100, and including means for homogenizing the current of air entering into the separation chamber 100. Preferably, this air chamber 130 is arranged upstream of the air diffuser 102*a* and it is connected to a compressor 131.

The means for homogenizing the current of air are, for example, glass balls 132. Their distribution in the air chamber 130 makes it possible to divide the current of compressed air, so that the current of air is uniform over its entire width when it enters into the chamber 100 and ensures a uniform horizontal pressure in the separation chamber 100.

According to other embodiments, the introduction of the granules can be done by projection from the bottom of the separation chamber, with the current of air (and, possibly, a complementary current of air) so that the granules projected upward levitate in the current of air in a turbulent mode and are electrically charged by contacts with one another and/or with the walls of the separation chamber.

The invention claimed is:

1. A method for electrostatically separating a mixture of granules of different materials, comprising:

a) injection, between two electrodes in a separation chamber delimited by walls and provided with an air inlet and outlet, of a current of fluidizing air;

b) introduction of the mixture of granules of different materials into the current of fluidizing air;

c) control of the current of fluidizing air, so that the granules levitate in the current of air in a turbulent mode and become electrically charged by contacts between them or with the walls of the separation chamber;

d) generation of an electric field between the two electrodes, substantially perpendicularly to the direction of the current of air, such that the granules charged in the control c) are displaced either in the direction of the electric field if they are charged positively or in the opposite direction if their charge is negative;

e) adhesion of the charged granules to the surface of the electrodes; and f) removal and collection of the granules adhered to each electrode.

2. The electrostatic separation method as claimed in claim 1, in which, in the injection a), the current of fluidizing air is injected substantially vertically upward, and in the introduction b), the granule mixture is introduced by free fall and in counterflow relative to the current of fluidizing air.

3. The electrostatic separation method as claimed in claim 2, in which the current of fluidizing air, injected into the separation chamber in the injection a), exhibits a negative pressure gradient in the vertically upward direction.

4. The electrostatic separation method as claimed in claim 1, in which the introduction of the granule mixture in the introduction b) is carried out at a rate, expressed in terms of weight of granules introduced per unit of time, regulated to a value substantially equal to the weight of granules collected in the removal and collection f) per unit of time.

5. The electrostatic separation method as claimed claim 1, in which the current of air is previously heated before entering into the separation chamber.

6. The electrostatic separation method as claimed in claim 1, in which the current of air is homogenized on entering into the separation chamber.

7. The electrostatic separation method as claimed in claim 1, in which the removal and collection f) is implemented by conveyor belt-type electrodes made of electrically conductive material, the removal of the granules being performed by translating the conveyor belts, and the collection being carried out by scraping.

8. The electrostatic separation method as claimed in claim 1, further comprising after the removal and collection f), g) cleaning the electrodes.

9. A device for electrostatically separating a mixture of granules of different materials, comprising:

a separation chamber delimited by walls and including an air inlet and outlet;

two electrodes extending into the separation chamber between the air inlet and outlet;

a means for injecting, between the two electrodes, a current of fluidizing air in a determined direction;

a means for introducing the mixture of granules into the current of fluidizing air;

a means for controlling the current of fluidizing air such that, in use, the granules levitate in the current of air in a turbulent mode and are electrically charged by contacts between them or with the walls of the separation chamber;

a means for generating, between the two electrodes, an electric field substantially perpendicularly to the direction of the current of air; and a means for removing and for collecting the granules adhered to each electrode.

10. The separation device as claimed in claim 9, in which the air inlet is arranged so that the current of air is, in use, substantially vertically upward.

11. The separation device as claimed in one of claim 9, in which the means for introducing the mixture of granules is arranged to introduce the granules, into the separation chamber, by free fall and in counterflow relative to the current of fluidizing air.

12. The separation device as claimed in claim 9, in which the electrodes are arranged so as to diverge from the air inlet toward the air outlet.

13. The separation device as claimed in claim 9, further comprising a means for heating the current of air arranged upstream of the air inlet of the separation chamber.

14. The separation device as claimed in claim 9, further comprising an air chamber arranged downstream of the air inlet of the separation chamber and including means for homogenizing the current of air.

15. The separation device as claimed in claim 14, in which the means for homogenizing the current of air includes glass balls.

16. The separation device as claimed in claim 9, further comprising a means for controlling a rate of introduction of the granules.

17. The separation device as claimed in claim 16, further comprising a means for measuring weight of granules collected, linked to the means for controlling the rate, the means for controlling the rate being adapted to control the rate of introduction of the granules according to the weight measured by the measurement means.

18. The separation device as claimed in claim 9, in which the means for collecting the granules includes a scraper.

19. The separation device as claimed in claim 9, further comprising a means for cleaning the electrodes.

20. The separation device as claimed in claim 9, in which the electrodes are of conveyor belt type.

21. The separation device as claimed in claim 9, in which the means for generating the electric field is adjustable.

* * * * *